US009560947B2

(12) United States Patent
Park et al.

(10) Patent No.: US 9,560,947 B2
(45) Date of Patent: Feb. 7, 2017

(54) ROBOT CLEANER

(71) Applicant: SAMSUNG ELECTRONICS CO., LTD., Suwon-si, Gyeonggi-do (KR)

(72) Inventors: Sung Jin Park, Suwon-si (KR); Jae Youl Jeong, Suwon-si (KR); Shin Kim, Hwaseong-si (KR); Heum Yong Park, Suwon-si (KR); Dong Hun Lee, Ansan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 509 days.

(21) Appl. No.: 14/132,942

(22) Filed: Dec. 18, 2013

(65) Prior Publication Data

US 2014/0196231 A1 Jul. 17, 2014

(30) Foreign Application Priority Data

Jan. 16, 2013 (KR) ..... 10-2013-0004841

(51) Int. Cl.
*A47L 11/40* (2006.01)

(52) U.S. Cl.
CPC ..... *A47L 11/4069* (2013.01); *A47L 11/4038* (2013.01); *A47L 11/4061* (2013.01); *A47L 11/4066* (2013.01); *A47L 2201/04* (2013.01)

(58) Field of Classification Search
CPC ..... A47L 11/4069; A47L 11/4038; A47L 11/4061; A47L 11/4066; A47L 2201/04
See application file for complete search history.

(56) References Cited

FOREIGN PATENT DOCUMENTS

| | | |
|---|---|---|
| CN | 201189140 | 2/2009 |
| DE | 100 00 407 | 7/2001 |
| JP | 59-152529 | 8/1984 |
| JP | 9-234177 | 9/1997 |
| JP | 9-299-298 | 11/1997 |
| KR | 20-349817 | 5/2004 |
| KR | 10-2008-0091042 | 12/2010 |
| KR | 10-2012-0009927 | 2/2012 |
| WO | WO 2012/086604 | 6/2012 |

OTHER PUBLICATIONS

International Search Report issued Apr. 23, 2014 in corresponding International Application No. PCT/KR2014/000411.
European Search Report issued May 27, 2014 in corresponding European Application No. 14150986.9.
Chinese Office Action issued on Sep. 28, 2016 in corresponding Chinese Patent Application No. 201480051247.
Decision on Grant issue on Sep. 19, 2016 in corresponding European Patent Application No. 14 150 986.9.

*Primary Examiner* — Shay Karls
(74) *Attorney, Agent, or Firm* — Staas & Halsey LLP

(57) ABSTRACT

A robot cleaner capable of moving in diverse directions and enhancing cleaning efficiency by increasing frictional force between a pad and a floor includes two or more driving units. Each of the driving units includes plural motors, a first subframe connected to at least any one of the motors and configured to rotate by receiving rotational force from the motor, a rotating plate assembly mounted to the first subframe and configured to be slanted with respect to a floor by rotation of the first subframe and to rotate clockwise or counterclockwise by receiving rotational force from another motor, and a pad provided at the rotating plate assembly and configured to contact the floor. When the rotating plate assembly is slanted with respect to the floor, nonuniform frictional force is generated between the pad and the floor, through which the robot cleaner travels.

23 Claims, 19 Drawing Sheets

ROBOT CLEANER

CROSS-REFERENCE TO RELATED APPLICATIONS

This application claims the benefit of Korean Patent Application No. 10-2013-0004841, filed on Jan. 16, 2013 in the Korean Intellectual Property Office, the disclosure of which is incorporated herein by reference.

BACKGROUND

1. Field

One or more embodiments relate to a robot cleaner capable of moving in diverse directions and enhancing cleaning efficiency by increasing frictional force between a pad and a floor.

2. Description of the Related Art

A robot cleaner is an appliance utilizing an automatic travel function to clean a room or the like by vacuuming foreign materials, such as dust, from a floor of a room without user intervention. The robot cleaner detects a distance to an obstacle, such as furniture, office supplies, walls or the like, present in a zone to be cleaned using a distance sensor, and changes traveling directions by selectively driving a left-wheel motor and a right-wheel motor to perform cleaning of the zone to be cleaned.

Besides robot cleaners capable of vacuuming foreign materials, such as dust, from a floor, robot cleaners capable of wiping floors have been developed recently. A conventional robot cleaner includes pads provided at a bottom thereof and wipes a floor by traveling with the pads closely contacting the floor. The conventional robot cleaner travels using a moving unit which is provided separately from a cleaning unit.

SUMMARY

One or more embodiments relate to a robot cleaner capable of smoothly moving in diverse directions and enhancing cleaning efficiency by increasing frictional force between a pad and a floor.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

In accordance with one or more embodiments, a robot cleaner may include a main body that may include two or more driving units and a case disposed outside the main body to define an external appearance thereof, wherein each of the driving units may include plural motors to generate rotational force, a first subframe connected to at least one of the motors and configured to rotate by receiving the rotational force from the motor, a rotating plate assembly mounted to the first subframe and configured to be slanted with respect to a floor by rotation of the first subframe and to rotate clockwise or counterclockwise by receiving the rotational force from another one of the plural motors, and a pad provided at a bottom surface of the rotating plate assembly and configured to contact the floor. When the bottom surface of the rotating plate assembly is slanted with respect to the floor, nonuniform frictional force may be generated between a bottom surface of the pad and the floor. The robot cleaner may travel in a specific direction through the nonuniform frictional force.

The plural motors may include a first motor and a second motor. The first subframe may rotate about an X-axis by the first motor and may rotate about a Y-axis by the second motor, and the bottom surface of the rotating plate assembly may be slanted with respect to the floor by rotation of the first subframe.

A slanted direction and a slanted angle of the bottom surface of the rotating plate assembly with respect to the floor may be changed according to a degree of rotation of the first subframe about the X-axis or the Y-axis. If the slanted direction of the bottom surface of the rotating plate assembly is changed, a traveling direction of the robot cleaner may be changed. If the slanted angle of the bottom surface of the rotating plate assembly is changed, the frictional force between the pad and floor may be changed.

The pad may be made of a compressible material so that even when the bottom surface of the rotating plate assembly is slanted with respect to the floor, a majority of the bottom surface of the pad comes into contact with the floor.

The first motor may be positioned above the first subframe and the first subframe may be configured to rotate through a rotating shaft connecting the first motor to the first subframe.

The second motor may be positioned next to the first subframe and the first subframe may be configured to rotate through a link connecting the second motor to the first subframe.

The rotating plate assembly may include a rotating shaft mounted to the first subframe and a rotating plate mounted to the rotating shaft.

The plural motors may further include a third motor and the rotating plate may be configured to rotate about the rotating shaft by the third motor.

The robot cleaner may travel through the two or more driving units, in each of which the rotating plate rotates about the rotating shaft while the first subframe is slanted with respect to the floor.

The robot cleaner may travel by reaction to the frictional force between the pad and the floor, and a traveling direction of the robot cleaner may be determined by a slanted direction with respect to the floor and a rotating direction of the rotating plate provided at each of the two or more driving units.

The two or more driving units may include a first driving unit and a second driving unit, and the first driving unit and the second driving unit may be mounted to a main frame.

If a right portion of the bottom surface of the rotating plate provided at the first driving unit and a right portion of the bottom surface of the rotating plate provided at the second driving unit contact the floor and if the rotating plate provided at the first driving unit rotates counterclockwise and the rotating plate provided at the second driving unit rotates clockwise, the robot cleaner may perform cleaning of the floor at a stationary location.

The robot cleaner may further include a third driving unit and a fourth driving unit. The second driving unit may be positioned next to the first driving unit, the third driving unit may be positioned to the rear of the first driving unit, and the fourth driving unit may be positioned to the rear of the second driving unit.

A rotating plate of the third driving unit may move in the same rotating direction and slanted angle as the rotating plate of the first driving unit, and a rotating plate of the fourth driving unit may move in the same rotating direction and slanted angle as the rotating plate of the second driving unit.

In accordance with one or more embodiments, a robot cleaner may include two or more driving units, each of which may include a rotating plate assembly provided with a pad at a bottom surface thereof, a frame to which the rotating plate assembly is mounted, a first motor connected with the frame through a first link and configured to enable the frame to be slanted with respect to a floor, a second motor connected with the frame through a second link arranged to cross the first link and configured to enable the frame to be slanted with respect to the floor, and a third motor mounted to the frame and configured to rotate the rotating plate assembly. When the frame is slanted with respect to the floor, nonuniform frictional force may be generated between the pad and the floor, and the robot cleaner may travel through the nonuniform frictional force and rotation of the rotating plate assembly.

The first link and the second link may be arranged perpendicular to each other.

The rotating plate assembly may include a rotating shaft provided with a gear at an outer circumferential surface thereof and a rotating plate connected with the rotating shaft.

The third motor may be mounted with a gear unit, which may be tooth-engaged with the gear of the rotating shaft.

The frame and the rotating plate may be fixed to each other through a locking unit inserted through the frame and the rotating plate.

The rotating plate may be formed with a hole at a side surface thereof, into which one end portion of the locking unit may be inserted. The frame may be formed with a hole into which the other end portion of the locking unit may be inserted.

Balls may be mounted to both end portions of the first link and both end portions of the second link.

The frame may be provided with ball receiving parts in which the balls are received, and rotational force of the first motor and the second motor may be transmitted to the frame.

As described above, the robot cleaner according to one or more embodiments may travel in all directions on the floor and may enhance cleaning efficiency by increasing frictional force between the pad and the floor.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
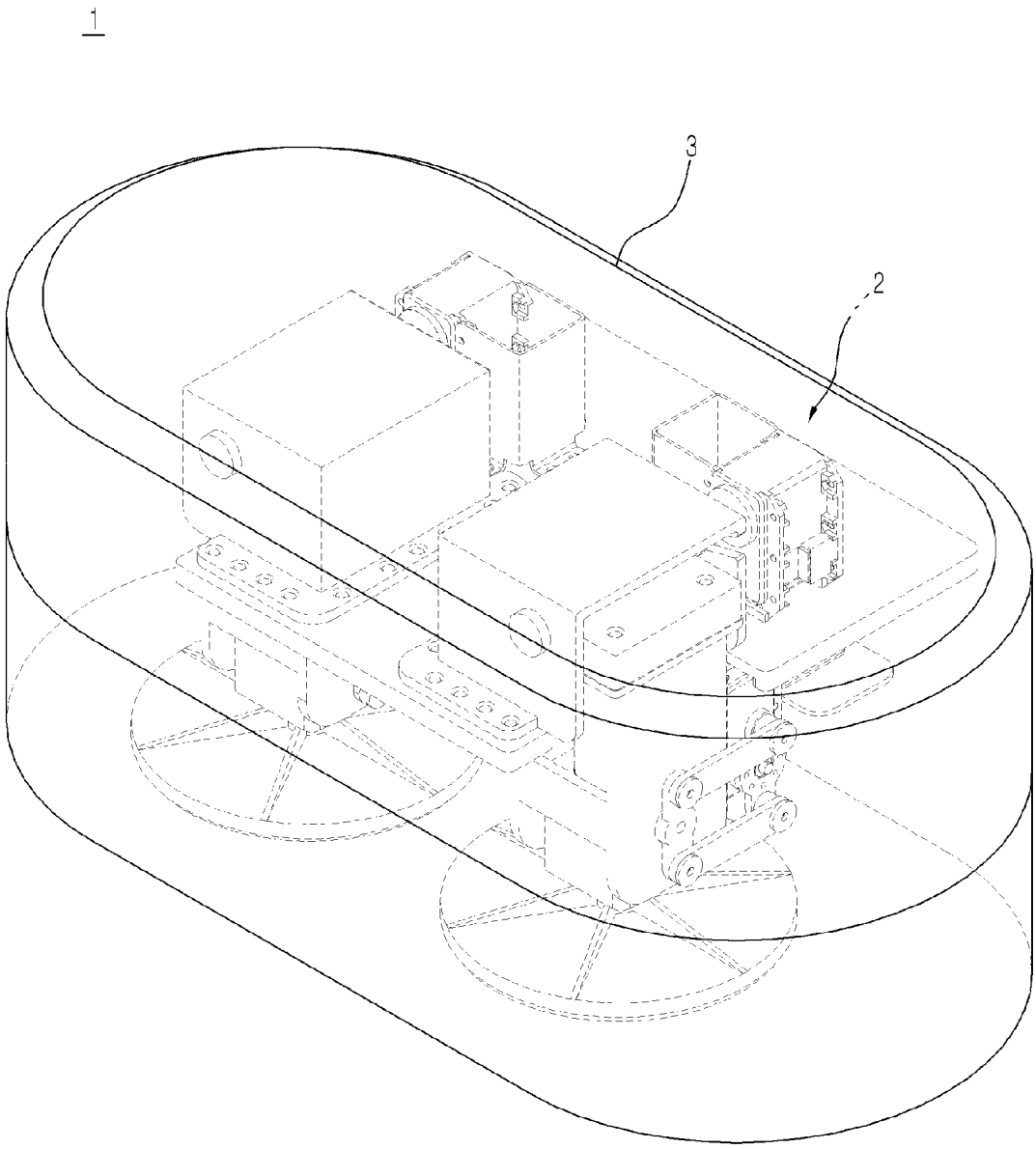
FIG. 1 is a perspective view illustrating a robot cleaner according to one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

Figure 2:
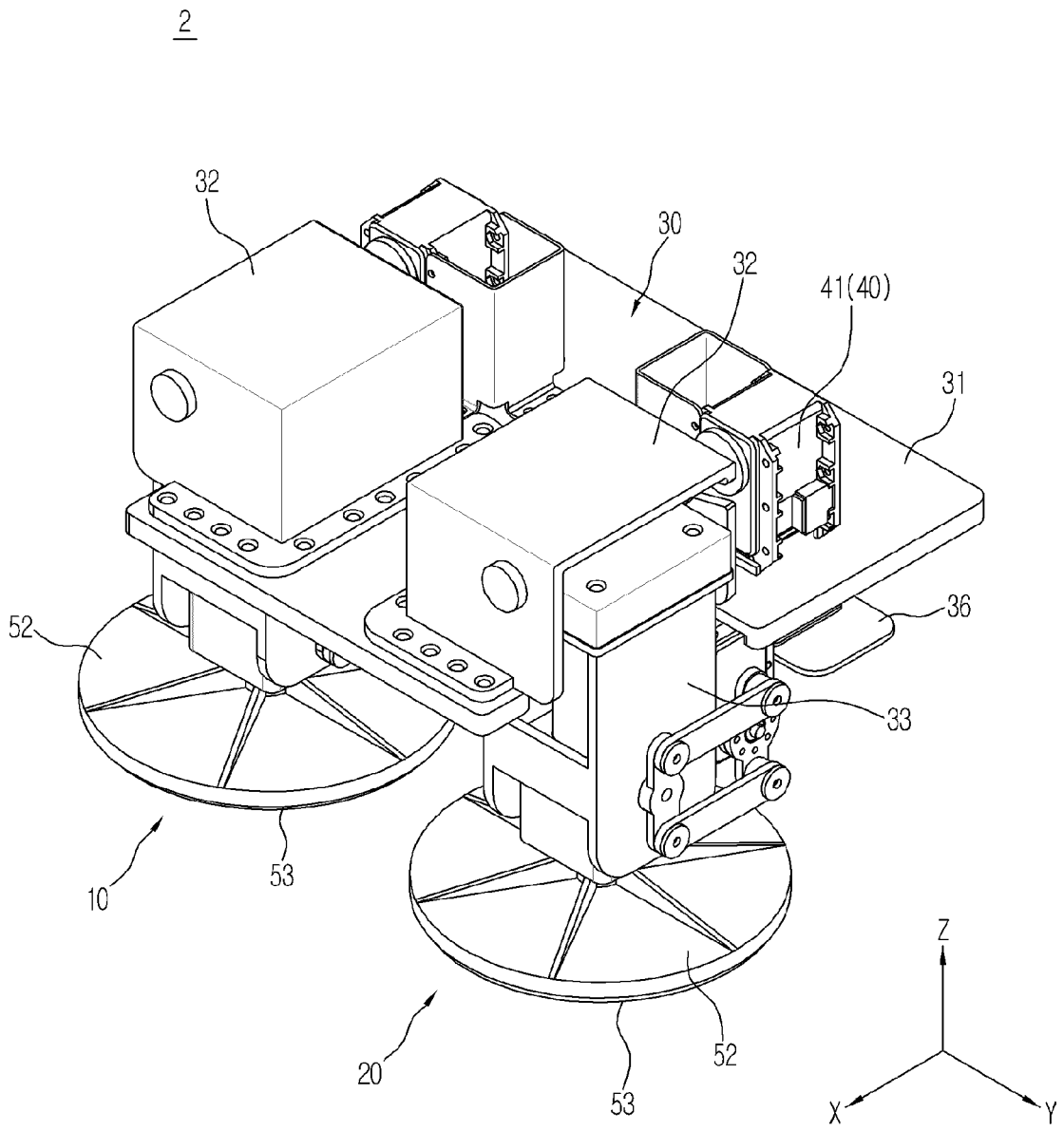
FIG. 2 is a perspective view illustrating a main body of the robot cleaner according to one or more embodiments.

FIG. 1 is a perspective view illustrating a robot cleaner according to one or more embodiments, and FIG. 2 is a perspective view illustrating a main body of the robot cleaner according to one or more embodiments.

Referring to FIGS. 1 and 2, a robot cleaner 1 according to one or more embodiments may include a main body 2 and a housing 3. The housing 3 may envelop the main body 2 and may form an external appearance of the robot cleaner 1.

The main body 2 may include a first driving unit 10 and a second driving unit 20. The second driving unit 20 may be provided corresponding to the first driving unit 10. Hereinafter, the first driving unit 10 will be explained. Operational structure and method of the first driving unit 10 may be similarly applied to the second driving unit 20.

The first driving unit 10 may include a frame 30, a motor 40 and a rotating plate assembly 50. The motor 40 and the rotating plate assembly 50 may be mounted to the frame 30. The frame 30 may include a main frame 31, and the first driving unit 10 and the second driving unit 20 may be mounted to the main frame 31, thereby forming the main body 2. The motor 40 may rotate the frame 30 mounted with the rotating plate assembly 50, to thereby vary a contact region of the rotating plate assembly 50 with the floor. The motor 40 also may rotate the rotating plate assembly 50 to clean the floor.

Hereinafter, a structure of the first driving unit 10 will be explained in detail with reference to the drawings.

Figure 3:
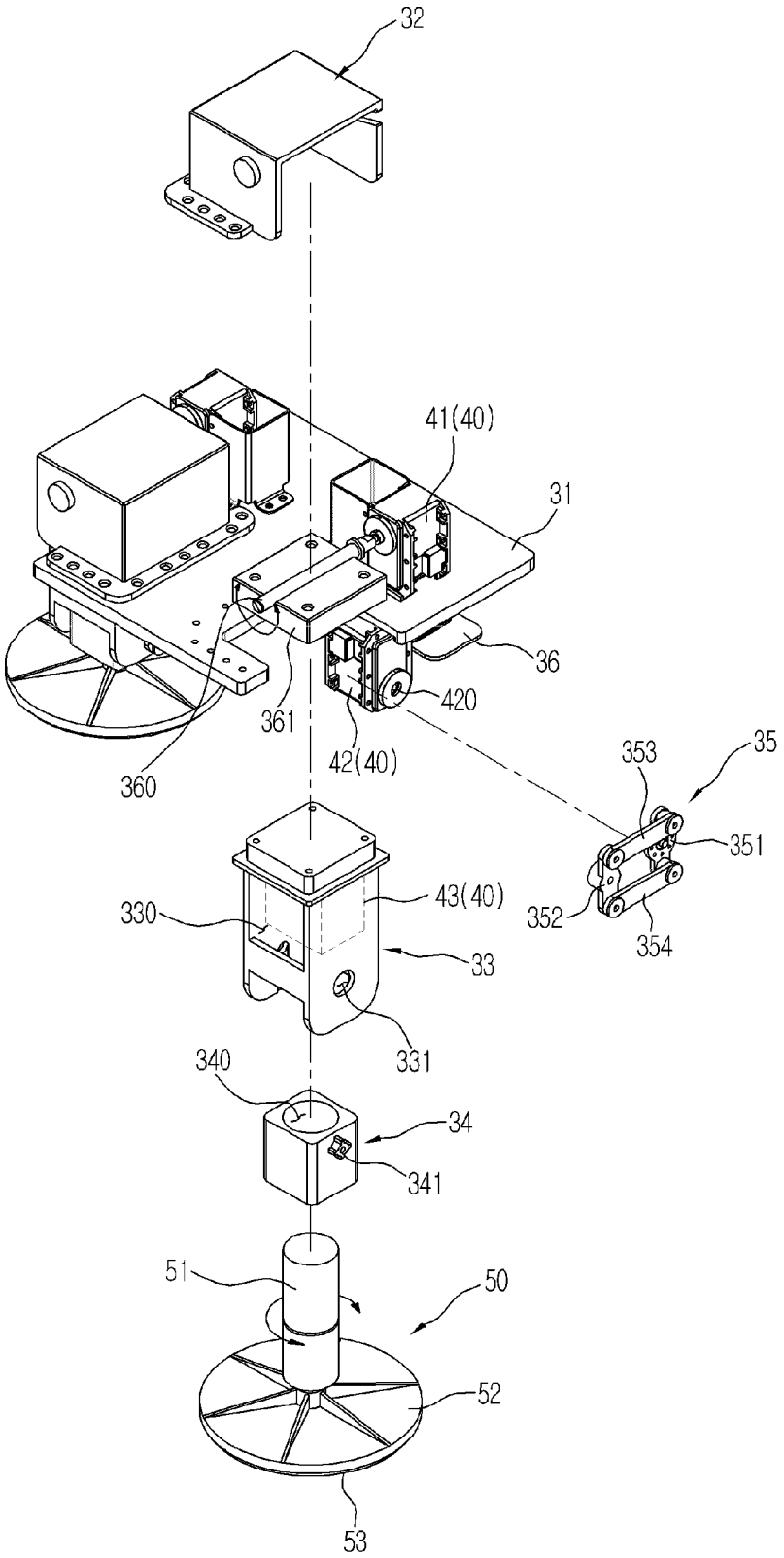
FIG. 3 is a partially exploded perspective view of the main body of the robot cleaner according to one or more embodiments.
Figure 4:
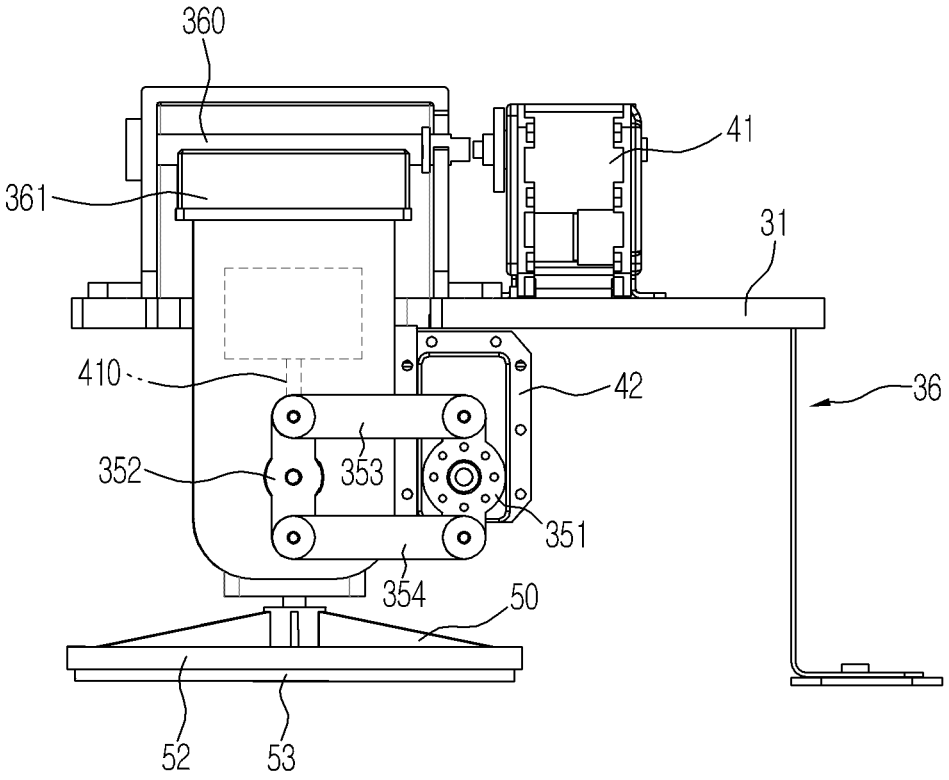
FIG. 4 is a side view of the main body of the robot cleaner according to one or more embodiments.

FIG. 3 is a partially exploded perspective view of the main body of the robot cleaner according to one or more embodiments, and FIG. 4 is a side view of the main body of the robot cleaner according to one or more embodiments.

Referring to FIGS. 3 and 4, the robot cleaner 1 according to one or more embodiments may include the frame 30, the motor 40 and the rotating plate assembly 50. The frame 30 may include a main frame 31, a fixing frame 32 and a first subframe 33. The first driving unit 10 and the second driving unit 20 may be mounted to the main frame 31, thereby forming the main body 2.

The fixing frame 32 may be coupled to the main frame 31 to cover an upper portion of the first driving unit 10. The fixing frame 32 may be fixed to an upper surface of the main frame 31 using a fastening member.

The first subframe 33 may be disposed below the main frame 31. The first subframe 33 may be formed with a receiving part 330, in which a driving motor 43 (which will be described later) and the rotating plate assembly 50 may be inserted. The rotating plate assembly 50 may include a rotating shaft 51, which may be connected to the driving motor 43 in the receiving part 330. The rotating shaft 51 may rotate clockwise or counterclockwise by the driving motor 43. A hole 331 may be formed at a portion of the first subframe 33.

A case 34 may also be inserted in the receiving part 330. The case 34 may be formed with a through-hole 340 through which the rotating shaft 51 may pass. The case 34 may further provided with a link coupling part 341. The rotating shaft 51 may pass through the through-hole 340 of the case 34 and may be connected to the driving motor 43 that may be disposed in the receiving part 330. The link coupling part 341 may be disposed at an outer surface of the case 34. The link coupling part 341 may be exposed to the outside of the first subframe 33 through the hole 331 formed at the first subframe 33.

The main frame 31 may be provided with a support frame 36 at a portion thereof to support the main frame 31. The support frame 36 may extend from a bottom surface of the main frame 31 and may contact the floor. Accordingly, in spite of rotation of the first subframe 33 and rotation of the rotating plate assembly 50, the main body 2 may stably move on the floor without shaking by virtue of the support frame 36.

The motor 40 may include a first control motor 41, a second control motor 42 and a driving motor 43. The first control motor 41 and the second control motor 42 may be servomotors, and the driving motor 43 may be a DC motor. The first control motor 41 may be positioned above the main frame 31. The second control motor 42 and the driving motor 43 may be positioned below the main frame 31. However, the positions of the first control motor 41 and the second control motor 42 are not limited to the above-described positions. The first control motor 41 and the second control motor 42 may be controlled to enable the first driving unit 10 to be slanted by a designated angle. In detail, the first control motor 41 may be controlled to rotate the first driving unit 10 about an X-axis, and the second control motor 42 may be controlled to rotate the first driving unit 10 about a Y-axis. The driving motor 43 may be controlled to rotate the rotating plate assembly 50 to rub the floor.

The first control motor 41 may be connected with a rotating shaft 360. The rotating shaft 360 may rotate clockwise or counterclockwise by the first control motor 41. When the rotating shaft 360 rotates, the first subframe 33 may rotate together with the rotating shaft 360.

In detail, the rotating shaft 360 may be connected with a second subframe 361. The second subframe 361 may be fixed to or formed integrally with the rotating shaft 360 in order to rotate together with the rotating shaft 360. The second subframe 361 may be connected to the first subframe 33. Accordingly, the first subframe 33 may also rotate when the second subframe 361 rotates. As a result, the first subframe 33 may rotate about the X-axis by the rotating shaft 360 which may rotate by the first control motor 41.

The second control motor 42 may be connected with the first subframe 33 to rotate the first subframe 33 about the Y-axis. In detail, the link coupling part 341 may be provided at a side surface of the case 34 that may be inserted in the receiving part 330 of the first subframe 33 and may be connected to the second control motor 42 through a link assembly 35.

The link assembly 35 may include a first link 351, a second link 352, a third link 353 and a fourth link 354. The first link 351 may be mounted to a drive shaft 420 that may be provided at the second control motor 42. The second link 352 may be mounted to the link coupling part 341 that may be provided at the side surface of the case 34. The third link 353 and the fourth link 354 may connect the first link 351 and the second link 352. The third link 353 and the fourth link 354 may be arranged in parallel with each other. Accordingly, if the drive shaft 420 of the second control motor 42 rotates clockwise or counterclockwise, the case 34 may rotate about the Y-axis by the link assembly 35. If the case 34 rotates about the Y-axis, the first subframe 33, in which the case 34 may be inserted, may also rotate about the Y-axis.

The rotating plate assembly 50 may include a rotating shaft 51, a rotating plate 52 and a pad 53. The rotating shaft 51 may be inserted into the case 34. One end of the rotating shaft 51 may be mounted to the driving motor 43 in the first subframe 33, and the other end of the rotating shaft 51 may be mounted with the rotating plate 52. The rotating plate 52 may rotate together with the rotating shaft 51 when the rotating shaft 51 rotates. The rotating plate 52 may be formed integrally with the rotating shaft 51. The pad 53, which may be made of a textile material to accomplish wet cleaning, may be attached to a bottom surface of the rotating plate 52. The rotating plate 52 may be provided with an adhesive part (not shown) at the bottom surface thereof, to which the pad 53 may be adhered. In the above-structured rotating plate assembly 50, if the rotating plate 52 rotates about a Z-axis by the driving motor 43, the pad 53 attached to the bottom surface of the rotating plate 52 may wipe the floor.

Figure 5:
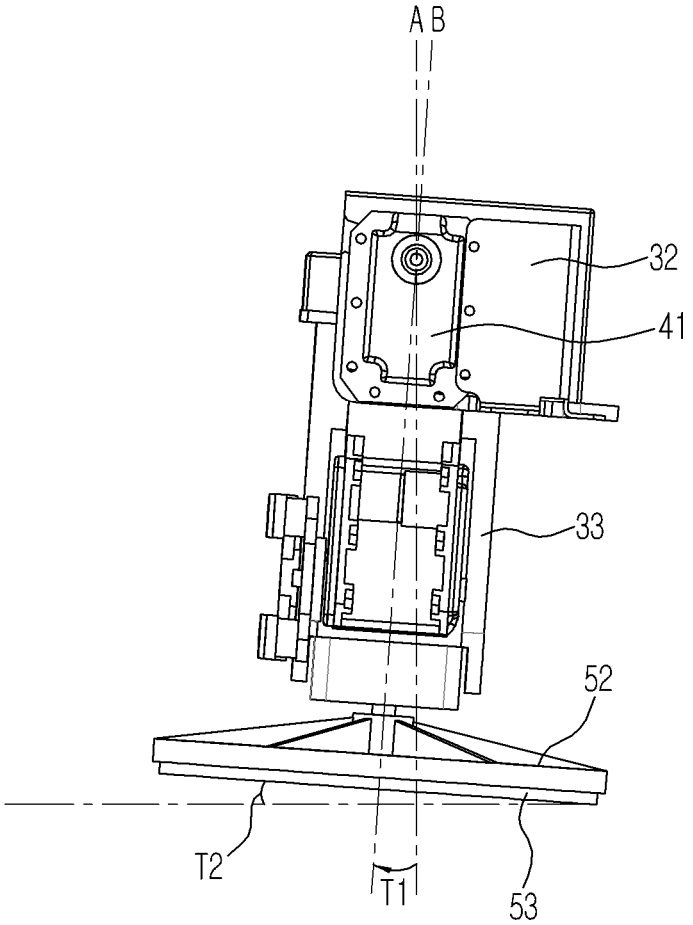
FIG. 5 is a view illustrating a rotating state of a first driving unit about an X-axis in the robot cleaner according to one or more embodiments.
Figure 6:
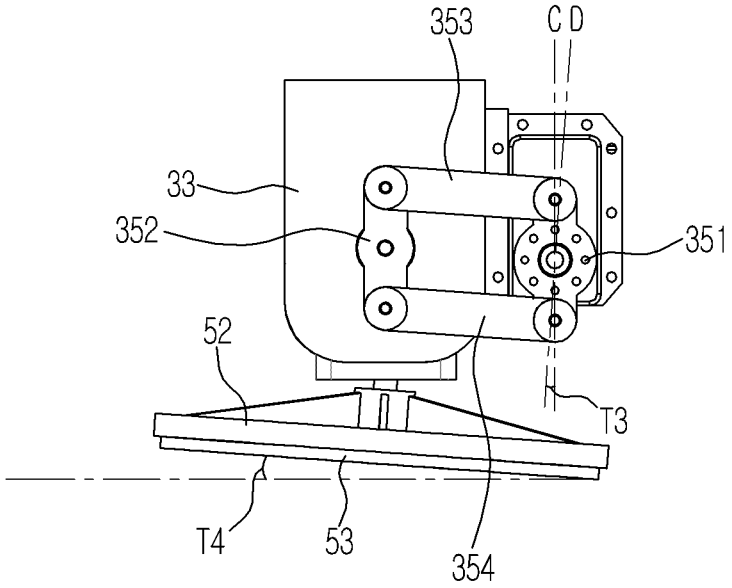
FIG. 6 is a view illustrating a rotating state of the first driving unit about a Y-axis in the robot cleaner according to one or more embodiments.

FIG. 5 is a view illustrating a rotating state of the first driving unit about the X-axis in the robot cleaner according to one or more embodiments, and FIG. 6 is a view illustrating a rotating state of the first driving unit about the Y-axis in the robot cleaner according to one or more embodiments.

Referring to FIGS. 5 and 6, the rotating plate 52 may be slanted by a designated angle with respect to the floor by the first driving unit 10 rotating about the X-axis or Y-axis.

If the rotating shaft 360 rotates a designated angle clockwise or counterclockwise about the X-axis by the first control motor 41, the second subframe 361 coupled to the rotating shaft 360, the first subframe 33 mounted to the second subframe 361, and the rotating plate assembly 50 mounted to the first subframe 33 may all be simultaneously pivoted. As exemplarily shown in FIG. 5, an angle T1 may be formed between an imaginary line A extending from the rotating shaft 51 of the rotating plate assembly 50 before rotation of the rotating shaft 360 and an imaginary line B extending from the rotating shaft 51 of the rotating plate assembly 50 after rotation of the rotating shaft 360 by a designated angle. At this time, an angle T2 may be formed between the bottom surface of the rotating plate 52 and the floor. The rotation angle T1 of the rotating shaft 360 may be the same as the angle T2 between the bottom surface of the rotating plate 52 and the floor. As described above, the rotating plate 52 may pivot about the X-axis.

If the drive shaft 420 of the second control motor 42 rotates, the first link 351 connected to the drive shaft 420 may also be rotated thereby. If the first link 351 rotates, the second link 352 connected to the first link 351 by the third and fourth links 353 and 354 may rotate in the same direction as the first link 351. For instance, if an angle T3 is formed between the imaginary lines C and D connecting a contact point of the first and third links 351 and 353 and a contact point of the first and fourth links 351 and 354 before and after rotation of the drive shaft 420, an angle T3 may be identically formed between imaginary lines connecting a contact point of the second and third links 352 and 353 and a contact point of the second and fourth links 352 and 354 before and after rotation of the drive shaft 420. As the second link 352 rotates, the case 34 connected with the second link 352 and the rotating plate assembly 50 provided at the case 34 may also pivot. Accordingly, an angle T4 may be formed between the bottom surface of the rotating plate 52 and the floor. The angle T3 and the angle T4 may be the same. As described above, the rotating plate 52 may pivot about the Y-axis.

Because the rotating plate 52 may be slanted with respect to the floor, nonuniform frictional force may be generated between the pad 53 provided at the bottom surface of the rotating plate 52 and the floor.

The rotating shaft 51 of the rotating plate assembly 50 may rotate by the driving motor 43 that may be positioned in the first subframe 33. Accordingly, the rotating plate 52 may rotate about the Z-axis.

The rotating plate 52 may rotate while being slanted by a designated angle with respect to the floor by the first control motor 41 and the second control motor 42. The rotating plate 52 may vary in terms of slanted angle and slanted direction with respect to the floor by the first control motor 41 and the second control motor 42. In detail, the rotating plate 52 may be slanted by pivoting about the X-axis by the first control motor 41 and may also be slanted by pivoting about the Y-axis by the second control motor 42. The slanted angle and the slanted direction of the rotating plate 52 with respect to the floor may be determined by a degree of rotation about the X-axis or Y-axis.

The pad 53 provided at the bottom surface of the rotating plate 52 may be made of a compressible material. Accordingly, the entire bottom surface of the pad 53 may come into contact with the floor even when the rotating plate 52 is slanted. Since force needed to wipe the floor is relatively large at a region having large frictional force between the pad 53 and the floor, cleaning efficiency (e.g., removal of stains from the floor) may be enhanced.

Difference in partial frictional force of the pad 53 may be generated according to the slanted angle of the rotating plate 52. Frictional force between the floor and a portion of the pad 53 corresponding to a region at which the rotating plate 52 and the floor are relatively close to each other may exceed frictional force between the floor and a portion of the pad 53 corresponding to a region at which the rotating plate 52 and the floor are relatively far from each other. Differences in frictional force between the pad 53 and the floor may cause the traveling direction and speed of the robot cleaner 1 to be varied.

The robot cleaner 1 may travel toward a region of large frictional force between the pad 53 and the floor. As frictional force between the pad 53 and the floor increases, magnitude of frictional force required to drive the robot cleaner 1 may be increased accordingly. Therefore, the traveling speed of the robot cleaner 1 may also be increased.

The first subframe 33 may be slanted by a designated angle in the X-axis direction by the first control motor 41 and may be slanted by a designated angle in the Y-axis direction by the second control motor 42. A control unit (not shown) controls the first control motor 41 and the second control motor 42 so that each of the slanted angles of the first subframe 33 in the X-axis direction and the Y-axis direction may be adequately adjusted. Accordingly, a specific portion of the pad 53 provided at the bottom surface of the rotating plate 52 may contact the floor at a specific contact area.

The robot cleaner 1 may perform cleaning while traveling in a specific direction according to a contact position of the pad 53 with the floor and a rotating direction of the rotating plate 52 or the pad 53 about the Z-axis. In detail, the traveling direction of the robot cleaner 1 may be changed according to the relative contact positions of the pad 53 provided at the first driving unit 10 and the pad 53 provided at the second driving unit 20 with the floor, or according to the rotating directions of the pad 53 provided at the first driving unit 10 and the pad 53 provided at the second driving unit 20 about the Z-axis. For instance, although the contact portions of the pads 53 of the first and second driving units 10 and 20 with the floor may be identical, when one of the pads 53 rotates clockwise and the other rotates counterclockwise, the traveling direction of the robot cleaner 1 may be changed.

As described above, because the robot cleaner 1 may travel by frictional force, between the pad 53 and the floor, functioning as driving force, traveling of the robot cleaner 1 may be free from restraint by a material of the floor or obstacles in comparison with a robot cleaner configured to travel using wheels. Further, the robot cleaner 1 may travel in all directions by adjusting the slanted angle and slanted direction of the rotating plate 52 and the rotating direction of the pad 53.

Figure 7A:
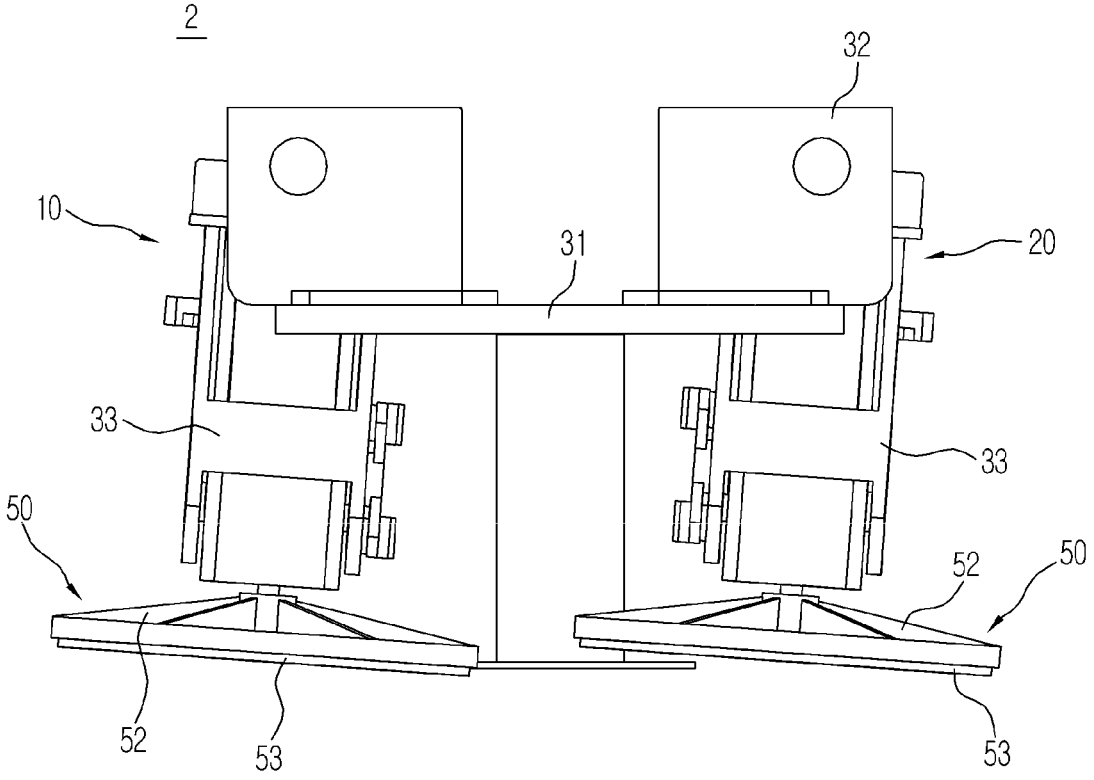
FIG. 7*a* is a view illustrating an operating state at a stationary location of the robot cleaner according to one or more embodiments.
Figure 7B:
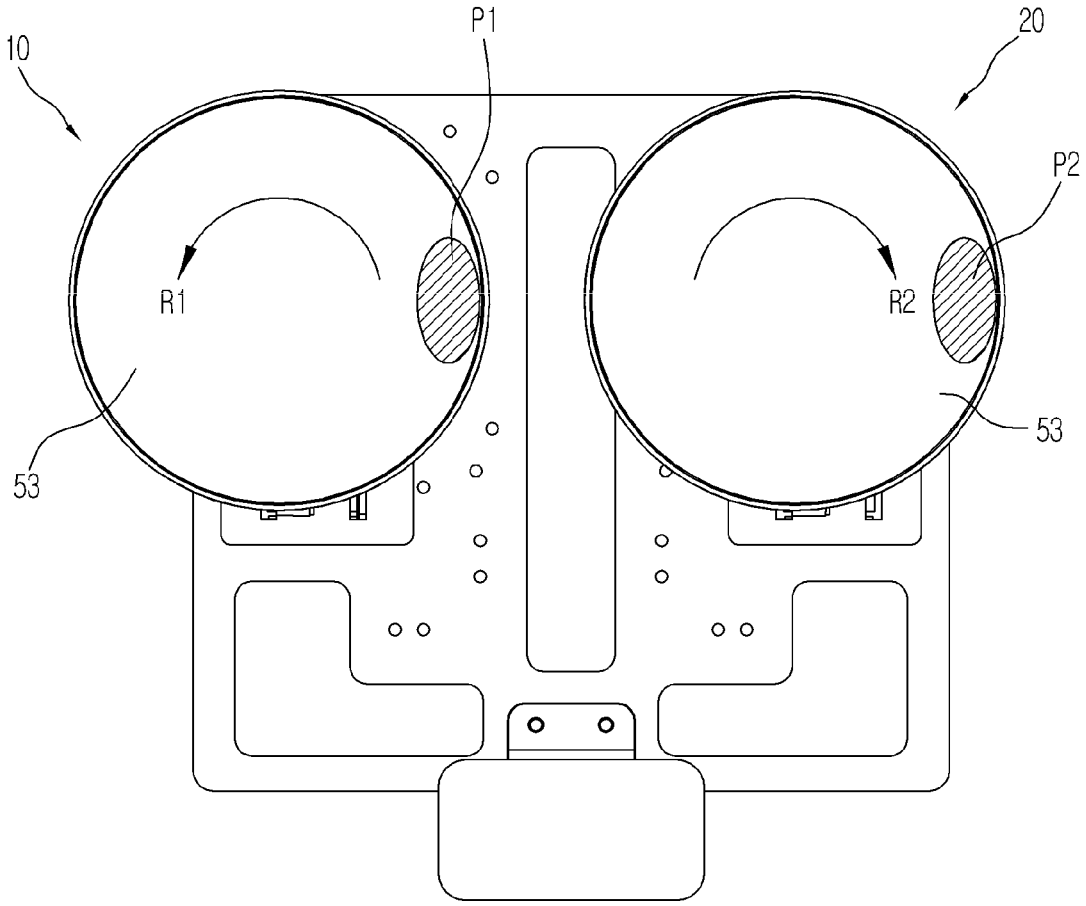
FIG. 7*b* is a view illustrating bottom surfaces of pads when the robot cleaner according to one or more embodiments operates at a stationary location.

FIG. 7*a* is a view illustrating an operating state at a stationary location of the robot cleaner according to one or more embodiments, and FIG. 7*b* is a view illustrating the bottom surfaces of the pads when the robot cleaner according to one or more embodiments operates at a stationary location.

Referring to FIGS. 7*a* and 7*b*, the rotating plate 52 provided at the first driving unit 10 and the rotating plate 52 provided at the second driving unit 20 may rotate while being slanted such that a right portion of the bottom surface of each rotating plate 52 is closest to the floor. At this time, frictional force between a right portion P1 of the bottom surface of the pad 53 provided at the first driving unit 10 and the floor may exceed frictional force between any other portion of the pad 53 and the floor. Similarly, frictional force between a right portion P2 of the bottom surface of the pad 53 provided at the second driving unit 20 and the floor may exceed frictional force between any other portion of the pad 53 and the floor. That is, P1 and P2 indicated in FIG. 7*b* are portions of the bottom surfaces of the respective pads 53, at which frictional force with the floor may be increased. At this time, the center of gravity of the robot cleaner may be between the pad 53 provided at the first driving unit 10 and the pad 53 provided at the second driving unit 20.

The rotating plate 52 of the first driving unit 10 may rotate counterclockwise R1. The rotating plate 52 of the second driving unit 20 may rotate clockwise R2. Because the rotating plate 52 of the first driving unit 10 and the rotating plate 52 of the second driving unit 20 may rotate in opposite directions with increased frictional force being applied between the right portions of the bottom surfaces of the pads 53 provided at the first and second driving units 10 and 20 and the floor, the robot cleaner 1 may operate at a stationary location, that is, without movement. Further, because the rotating plate 52 may rotate about the Z-axis, the pad 53 may clean the floor by rotating at a stationary location.

Figure 8A:
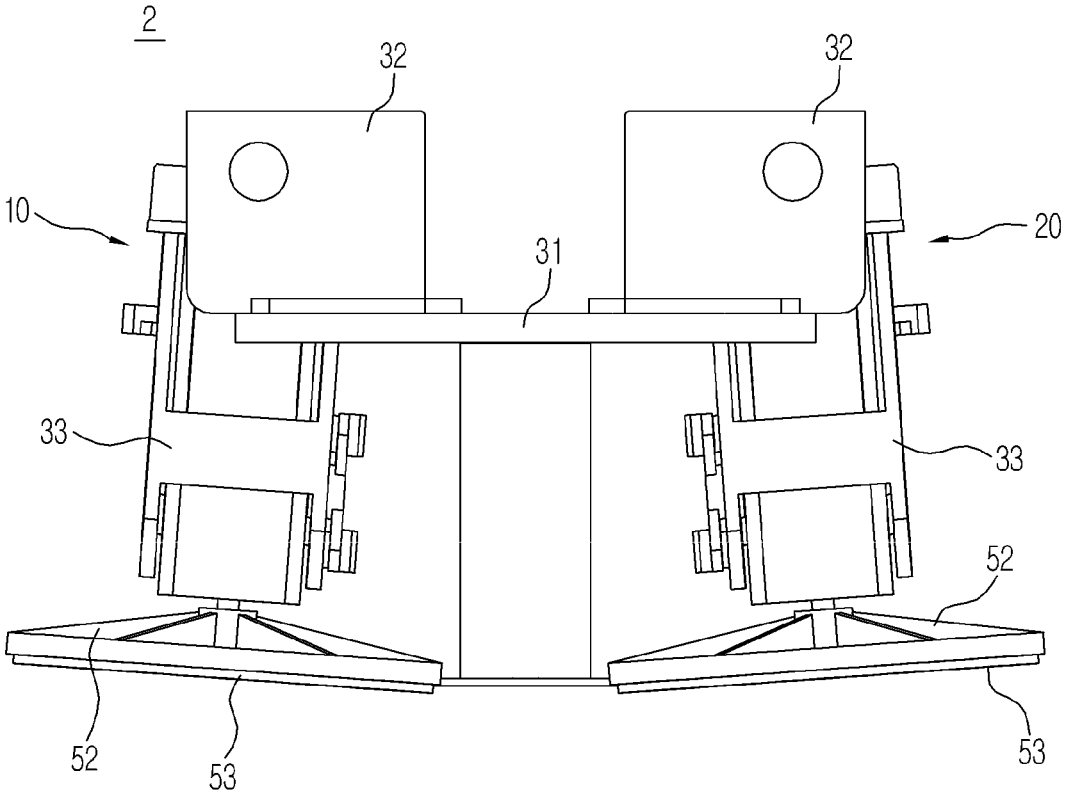
FIG. 8*a* is a view illustrating a backward moving state of the robot cleaner according to one or more embodiments.
Figure 8B:
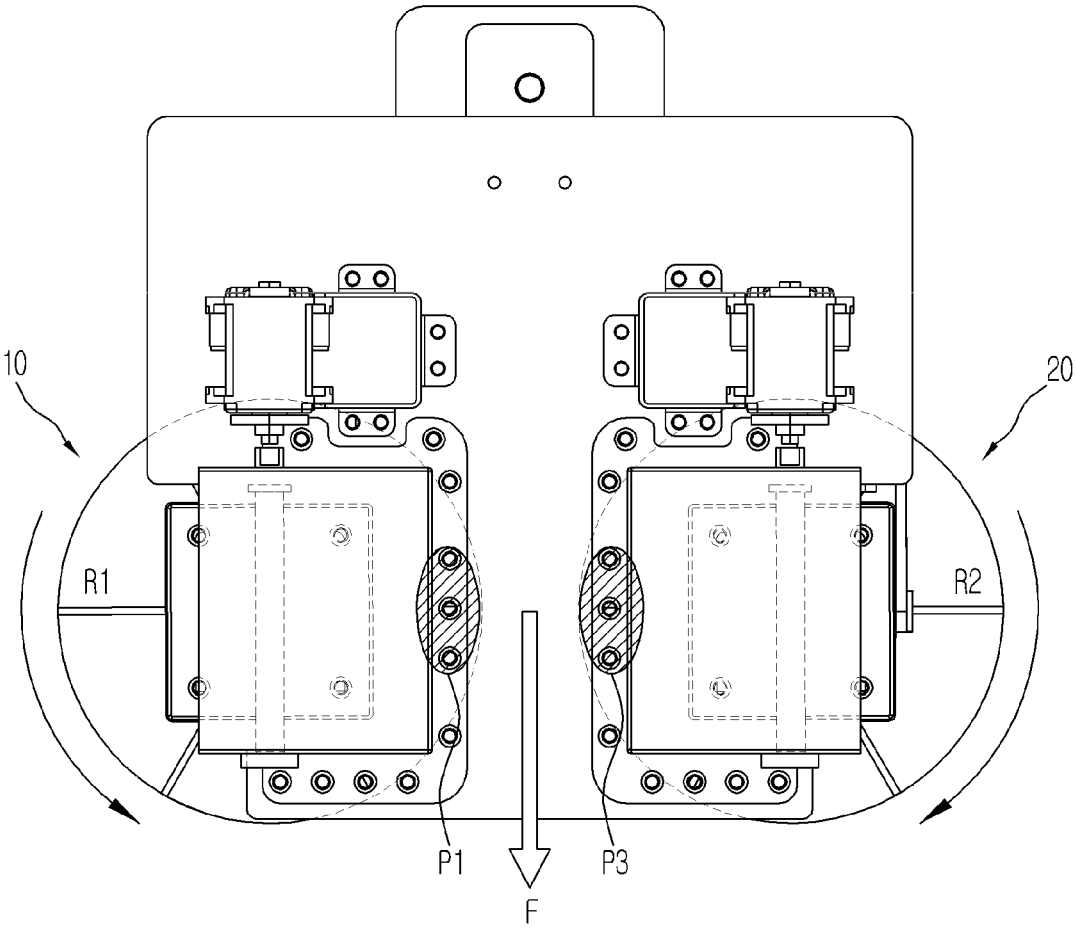
FIG. 8*b* is a view illustrating the bottom surfaces of the pads when the robot cleaner according to one embodiment of the present invention moves backward.

FIG. 8*a* is a view illustrating a backward moving state of the robot cleaner according to one or more embodiments, and FIG. 8*b* is a view illustrating the bottom surfaces of the pads when the robot cleaner according to one or more embodiments moves backward.

Referring to FIGS. 8*a* and 8*b*, the rotating plate 52 provided at the first driving unit 10 and the rotating plate 52 provided at the second driving unit 20 may rotate while being slanted such that a right portion of the bottom surface of the rotating plate 52 of the first driving unit 10 and a left portion of the bottom surface of the rotating plate 52 of the second driving unit 20 are closest to the floor. At this time, frictional force between a right portion P1 of the bottom surface of the pad 53 provided at the first driving unit 10 and the floor may exceed frictional force between any other portion of the pad 53 and the floor. Similarly, frictional force between a left portion P3 of the bottom surface of the pad 53 provided at the second driving unit 20 and the floor may exceed frictional force between any other portion of the pad 53 and the floor. That is, P1 and P3 indicated in FIG. 8*b* are portions of the bottom surfaces of the respective pads 53, at which frictional force with the floor may be increased.

At this time, the rotating plate 52 of the first driving unit 10 may rotate counterclockwise R1. The rotating plate 52 of the second driving unit 20 may rotate clockwise R2. Because the rotating plate 52 of the first driving unit 10 and the rotating plate 52 of the second driving unit 20 may rotate in opposite directions (i.e., counterclockwise R1 and clockwise R2, respectively) with increased frictional force being applied between the right portion P1 of the bottom surface of the pad 53 of the first driving unit 10 and the floor and between the left portion P3 of the bottom surface of the pad 53 of the second driving unit 20 and the floor, the robot cleaner 1 may move backward (in a direction F indicated in FIG. 8*b*) by reaction to frictional force applied between the pads 53 of the first and second driving units 10 and 20 and the floor.

Figure 9A:
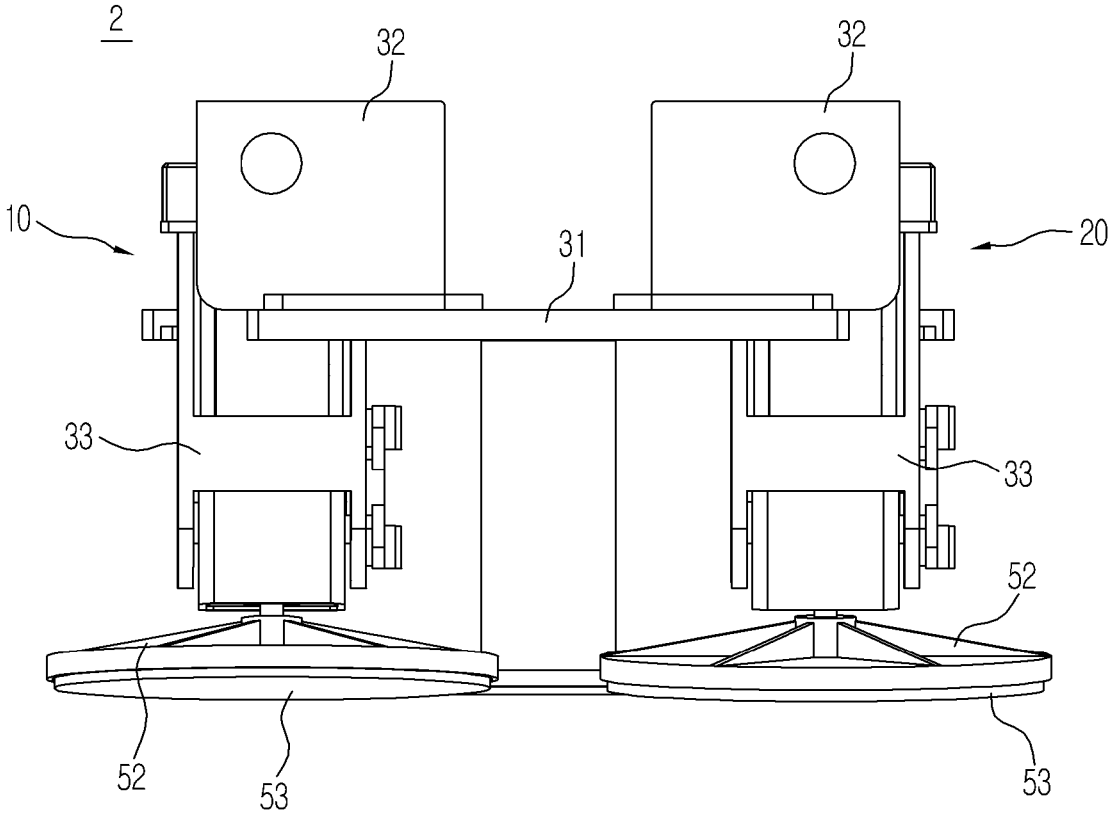
FIG. 9*a* is a view illustrating a sideward moving state of the robot cleaner according to one or more embodiments.
Figure 9B:
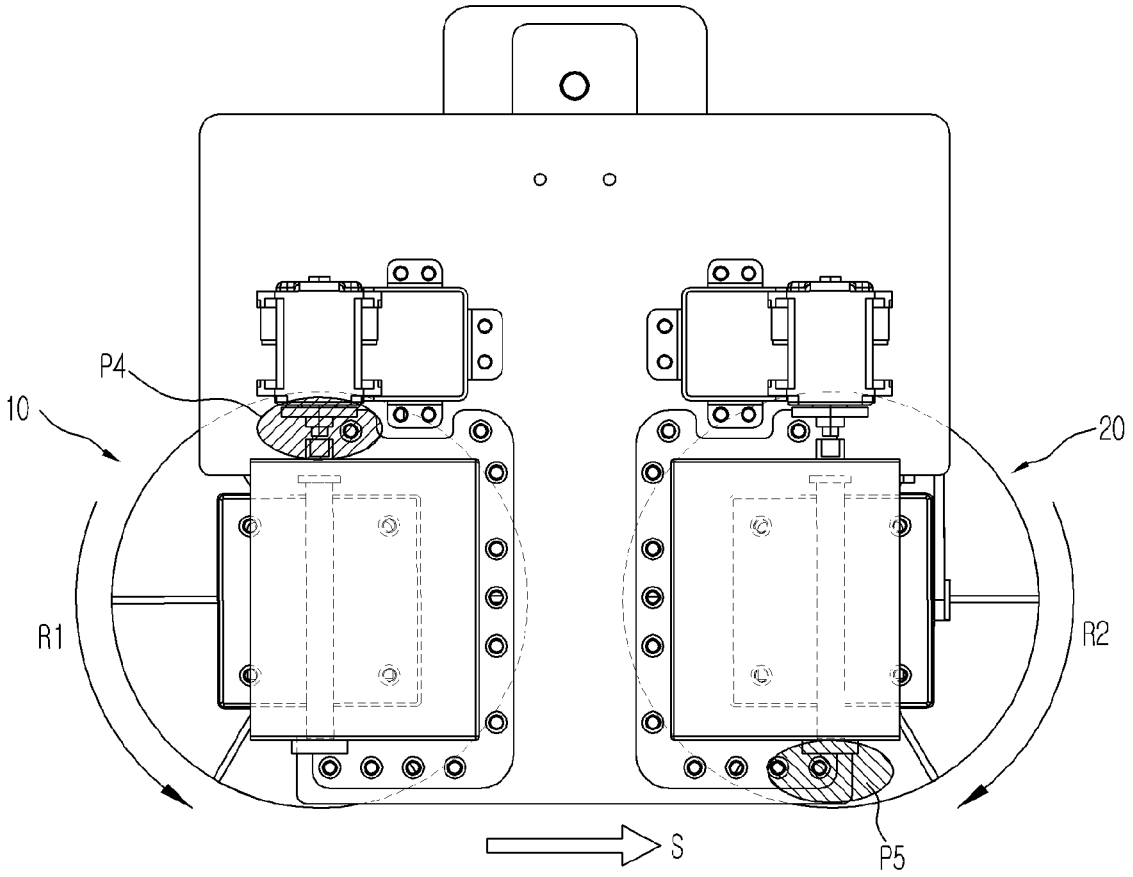
FIG. 9*b* is a view illustrating the bottom surfaces of the pads when the robot cleaner according to one or more embodiments moves sideways.

FIG. 9*a* is a view illustrating a sideward moving state of the robot cleaner according to one or more embodiments, and FIG. 9*b* is a view illustrating the bottom surfaces of the pads when the robot cleaner according to one or more embodiments moves sideways.

Referring to FIGS. 9*a* and 9*b*, the rotating plate 52 provided at the first driving unit 10 and the rotating plate 52 provided at the second driving unit 20 may rotate while being slanted such that a front portion of the bottom surface of the rotating plate 52 of the first driving unit 10 and a rear portion of the bottom surface of the rotating plate 52 of the second driving unit 20 are closest to the floor. At this time, frictional force between a front portion P4 of the bottom surface of the pad 53 provided at the first driving unit 10 and the floor may exceed frictional force between any other portion of the pad 53 and the floor. Similarly, frictional force between a rear portion P5 of the bottom surface of the pad 53 provided at the second driving unit 20 and the floor may exceed frictional force between any other portion of the pad 53 and the floor. That is, P4 and P5 indicated in FIG. 9*b* are portions of the bottom surfaces of the respective pads 53, at which frictional force with the floor may be increased.

At this time, the rotating plate 52 of the first driving unit 10 may rotate counterclockwise R1. The rotating plate 52 of the second driving unit 20 may rotate clockwise R2. Because the rotating plate 52 of the first driving unit 10 and the rotating plate 52 of the second driving unit 20 may rotate in opposite directions (i.e., counterclockwise R1 and clockwise R2, respectively) with increased frictional force being applied between the front portion P4 of the bottom surface of the pad 53 of the first driving unit 10 and the floor and between the rear portion P5 of the bottom surface of the pad 53 of the second driving unit 20 and the floor, the robot cleaner 1 may move to the right (in a direction S indicated in FIG. 9*b*) by reaction to frictional force applied between the pads 53 of the first and second driving units 10 and 20 and the floor.

Figure 10A:
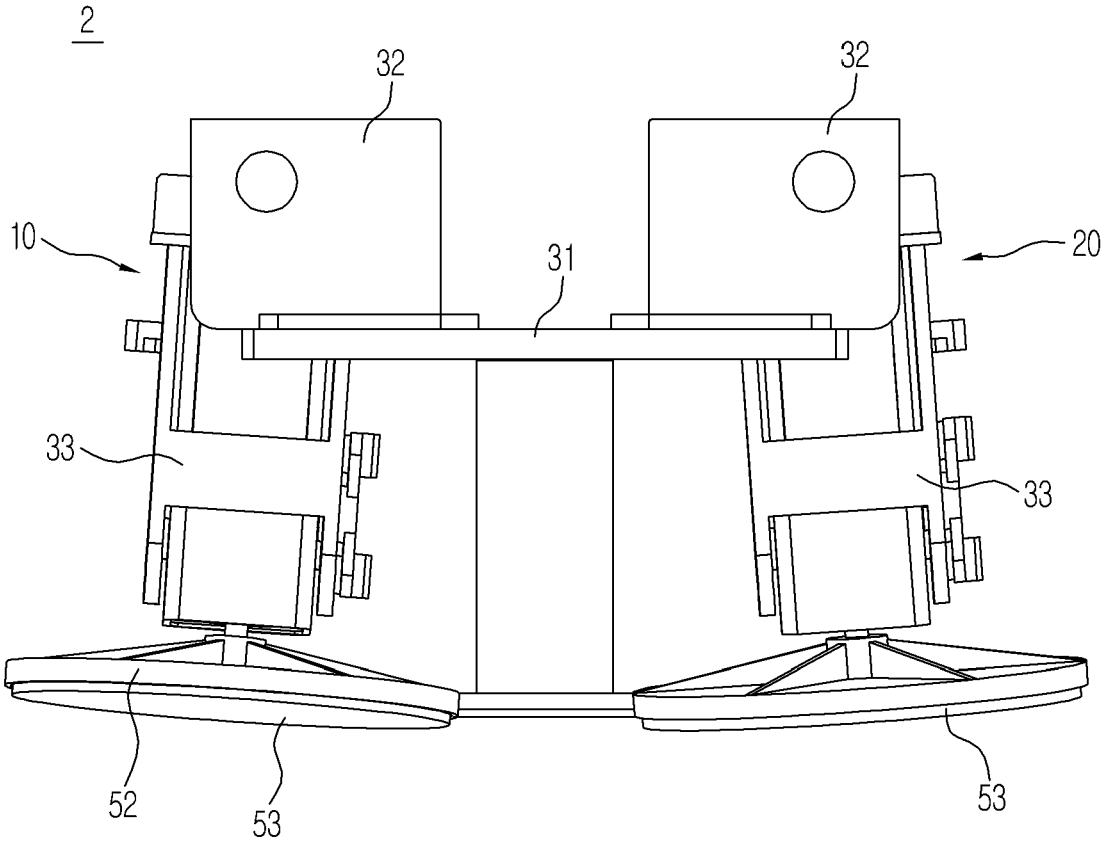
FIG. 10*a* is a view illustrating a diagonally moving state of the robot cleaner according to one or more embodiments.
Figure 10B:
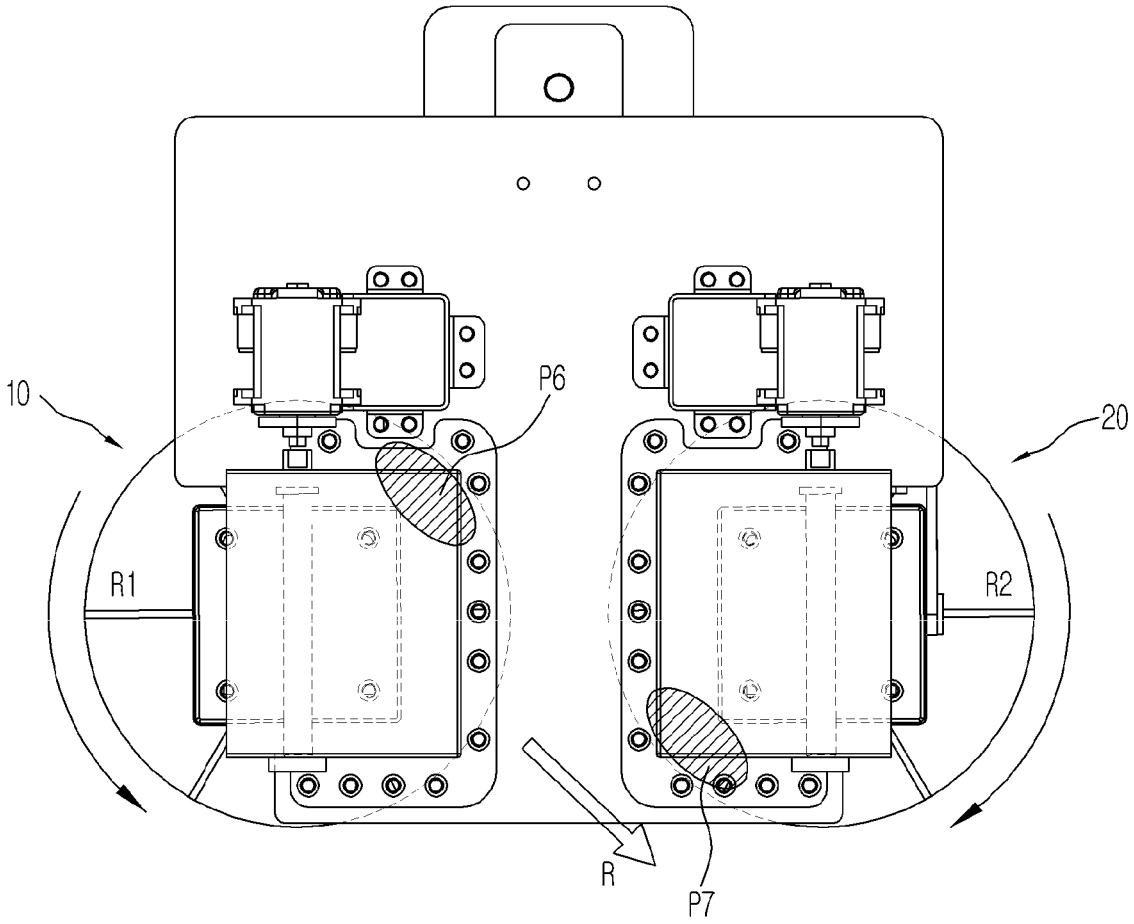
FIG. 10*b* is a view illustrating the bottom surfaces of the pads when the robot cleaner according to one or more embodiments moves diagonally.

FIG. 10*a* is a view illustrating a diagonally moving state of the robot cleaner according to one or more embodiments, and FIG. 10*b* is a view illustrating the bottom surfaces of the pads when the robot cleaner according to one or more embodiments moves diagonally.

Referring to FIGS. 10*a* and 10*b*, the rotating plate 52 provided at the first driving unit 10 and the rotating plate 52 provided at the second driving unit 20 may rotate while being slanted such that a right-front portion of the bottom surface of the rotating plate 52 of the first driving unit 10 and a left-rear portion of the bottom surface of the rotating plate 52 of the second driving unit 20 are closest to the floor. At this time, frictional force between a right-front portion P6 of the bottom surface of the pad 53 provided at the first driving unit 10 and the floor may exceed frictional force between any other portion of the pad 53 and the floor. Similarly, frictional force between a left-rear portion P7 of the bottom surface of the pad 53 provided at the second driving unit 20 and the floor may exceed frictional force between any other portion of the pad 53 and the floor. That is, P6 and P7 indicated in FIG. 10*b* are portions of the bottom surfaces of the respective pads 53, at which frictional force with the floor may be increased.

At this time, the rotating plate 52 of the first driving unit 10 may rotate counterclockwise R1. The rotating plate 52 of the second driving unit 20 may rotate clockwise R2. Because the rotating plate 52 of the first driving unit 10 and the rotating plate 52 of the second driving unit 20 may rotate in opposite directions (i.e., counterclockwise R1 and clockwise R2, respectively) with increased frictional force being applied between the right-front portion P6 of the bottom surface of the pad 53 of the first driving unit 10 and the floor and between the left-rear portion P7 of the bottom surface of the pad 53 of the second driving unit 20 and the floor, the robot cleaner 1 may move diagonally backward to the right (in a direction R indicated in FIG. 10*b*) by reaction to frictional force applied between the pads 53 of the first and second driving units 10 and 20 and the floor.

Figure 11:
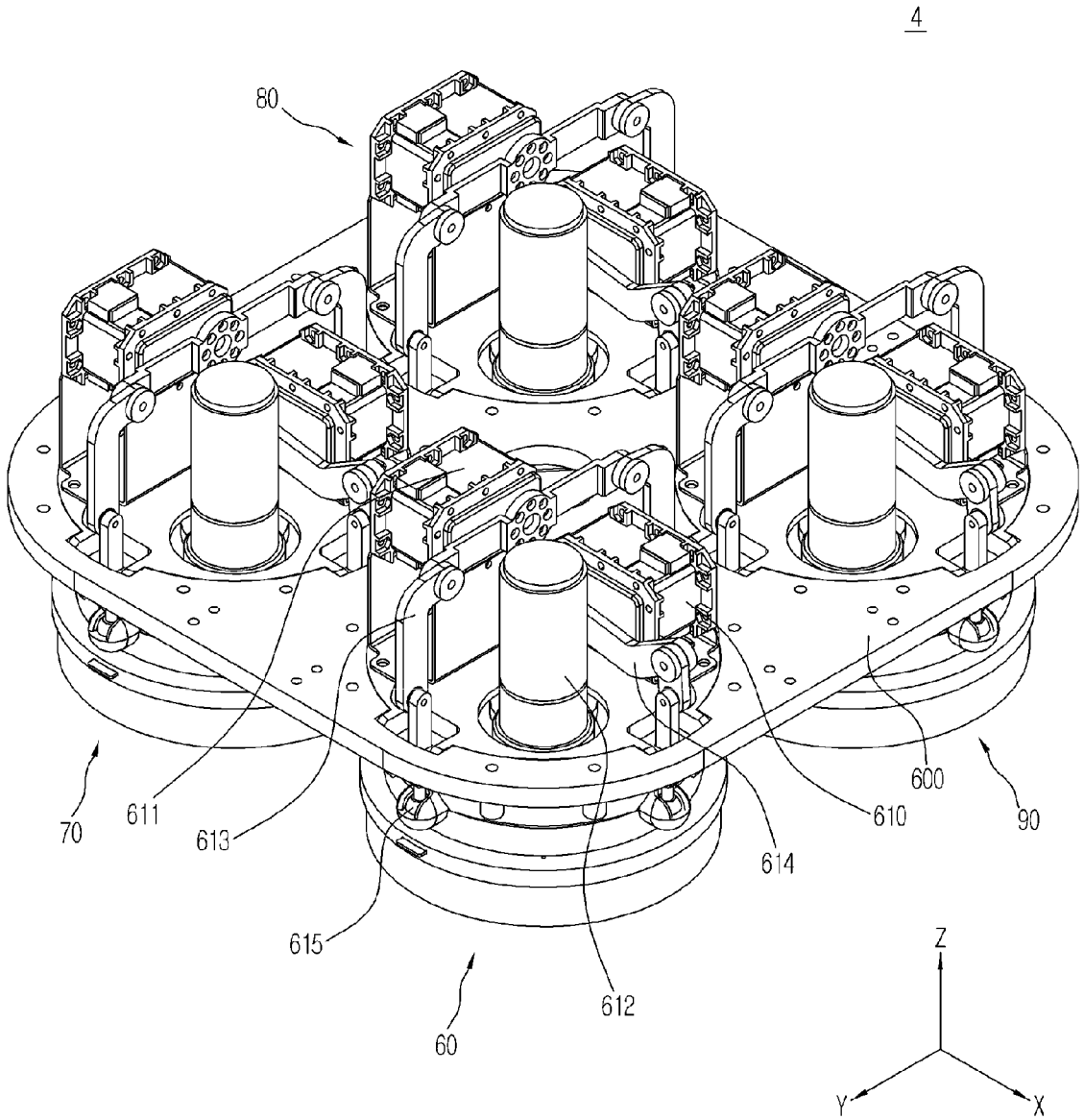
FIG. 11 is a view illustrating a main body of a robot cleaner according to one or more embodiments.

FIG. 11 is a view illustrating a main body of a robot cleaner according to one or more embodiments.

Referring to FIG. 11, a main body 4 of a robot cleaner according to one or more embodiments may include a first driving unit 60, a second driving unit 70, a third driving unit 80 and a fourth driving unit 90. The first driving unit 60, the second driving unit 70, the third driving unit 80 and the fourth driving unit 90 may be mounted to a frame 600. Since the second driving unit 70, the third driving unit 80 and the fourth driving unit 90 have the same constitution as the first driving unit 60, constitution of the first driving unit 60 will be representatively explained hereinafter.

Figure 12:
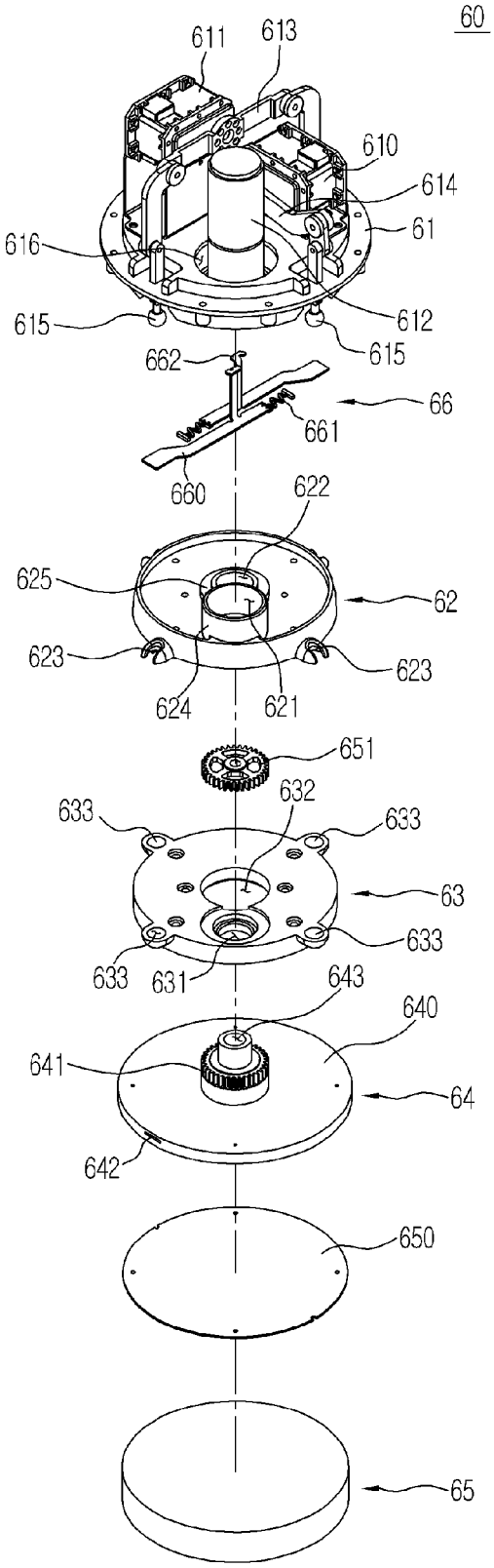
FIG. 12 is an exploded perspective view of a first driving unit of the robot cleaner according to one or more embodiments.
Figure 13:
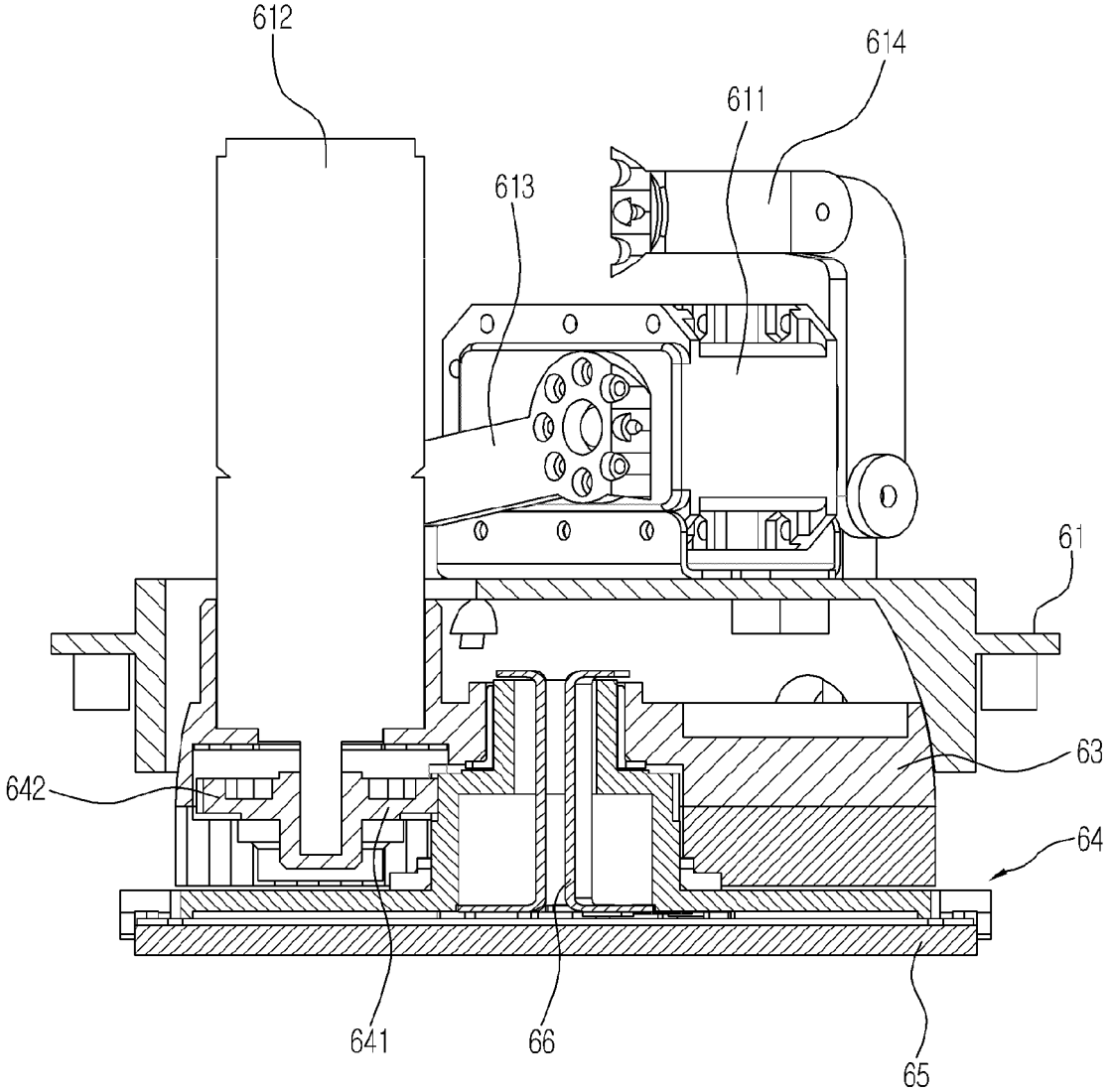
FIG. 13 is a sectional view of the first driving unit of the robot cleaner according to one or more embodiments.

FIG. 12 is an exploded perspective view of the first driving unit of the robot cleaner according to one or more embodiments, and FIG. 13 is a sectional view of the first driving unit of the robot cleaner according to one or more embodiments.

Referring to FIGS. 12 and 13, the first driving unit 60 may include a fixing frame 61, a first subframe 62, a second subframe 63, a rotating plate assembly 64, and a pad 65. A first control motor 610 and a second control motor 611 may be disposed above the fixing frame 61. A driving motor 612 may be mounted to the first subframe 62.

The first control motor 610 may be connected to the first link 614 and the second control motor 611 may be connected to the second link 613. The first link 614 may be connected to a drive shaft of the first control motor 610. The first link 614 may have a pair of end portions which may be bent to be seated on the first subframe 62. A ball 615 may be mounted to each of the end portions of the first link 614. Similarly, the second link 613 may be connected to a drive shaft of the second control motor 611 and may have a pair of end portions which may be bent to be seated on the first subframe 62. A ball 615 may be mounted to each of the end portions of the second link 613. The first link 614 and the second link 613 may be arranged to cross each other. For instance, the first link 614 connected to the first control motor 610 and the second link 613 connected to the second control motor 611 may be arranged perpendicular to each other. However, the crossing angle between the first link 614 and the second link 613 is not limited to 90 degrees. The fixing frame 61 may be formed with a hole 616 into which the driving motor 612 may be inserted so as to be connected to an external power source or the like.

The first subframe 62 may be disposed below the fixing frame 61. The first subframe 62 may be provided with s 623 defining spaces in which the balls 615 respectively provided at both end portions of the first link 614 and the second link 613 may be inserted. The first subframe 62 may be formed with a hole 625 in which the driving motor 612 may be inserted and a rotating shaft insertion hole 622 in which a rotating shaft 641 provided at the rotating plate assembly 64 may be inserted. The hole 625 and the rotating shaft insertion hole 622 may be positioned adjacently. The hole 625 of the first subframe 62 may communicate with the hole 616 of the fixing frame 61.

The second subframe 63 may be formed with a rotating shaft insertion hole 632 in which the rotating shaft 641 provided at the rotating plate assembly 64 may be inserted. The rotating shaft insertion hole 632 of the second subframe 63 may communicate with the rotating shaft insertion hole 622 of the first subframe 62. The second subframe 63 may also be formed with a gear receiving part 631 in which a gear unit 651 may be received.

The second subframe 63 may be provided with second ball receiving parts 633 defining spaces in which the balls 615 respectively provided at both end portions of the first link 614 and the second link 613 may be inserted. When the first subframe 62 and the second subframe 63 are coupled, each of the first ball receiving parts 623 of the first subframe 62 and each of the second ball receiving parts 633 of the second subframe 63 may define a unitary ball receiving space together, in which each of the balls 615 provided at the first and second links 614 and 613 may be received. Through such engagement using the balls 615 and the first and second ball receiving parts 623 and 633, the first subframe 62 and the second subframe 63 may be tilted according to operation of the first link 614 and the second link 613.

The gear receiving part 631 may receive one end portion of the driving motor 612 inserted through the hole 616 of the fixing frame 61 and the hole 621 of the first subframe 62. That is, the gear unit 651 may be coupled to one end portion of the driving motor 612 and the gear unit 651 may be received in the gear receiving part 631 of the second subframe 63. A portion of the gear receiving part 631 and a portion of the rotating shaft insertion hole 632 may communicate with each other, so that the rotating shaft 641 of the rotating plate assembly 64 may be tooth-engaged with the gear unit 651.

The rotating plate assembly 64 provided with the rotating shaft 641 may further include a rotating plate 640. The rotating shaft 641 may be positioned at a center portion of an upper surface of the rotating plate 640. The rotating shaft 641 may be formed with a through-hole 643. A chamber (not shown) may be mounted in the through-hole 643 to supply water to the pad 65 mounted to a bottom surface of the rotating plate 640. The rotating shaft 641 may be provided with a gear at an outer circumferential surface thereof, which may be configured to be tooth-engaged with the gear unit 651. The rotating plate 640 may be formed with a locking hole 642 at a side surface thereof, into which a locking unit 66 may be inserted.

In order to mount the pad 65 to the bottom surface of the rotating plate assembly 64, the rotating plate 640 may be provided with an adhesive part 650, to which the pad 65 may be adhered, at the bottom surface thereof.

If the gear unit 651 coupled to the driving motor 612 rotates, the rotating shaft 641 tooth-engaged with the gear unit 651 may rotate and thus the rotating plate 640 may rotate about the Z-axis. Accordingly, the pad 65 may wipe the floor while rotating at a stationary location.

The first driving unit 60 further may include a locking unit 66. The locking unit 66 may pass through the rotating shaft insertion hole 622 of the first subframe 62, the rotating shaft insertion hole 632 of the second subframe 63, and the through-hole 643 of the rotating shaft 641. The locking unit 66 may include a bent part 662 formed at a top thereof. The bent part 662 may pass through the rotating shaft insertion holes 622 and 632 and may be hung on an upper surface of the first subframe 62. A lower end of the locking unit 66 may be positioned at a bottom surface of the rotating plate 640. The lower end of the locking unit 66 may be inserted into the locking hole 642 formed at the side surface of the rotating plate 640. Accordingly, the first subframe 62, the second subframe 63 and the rotating plate 640 may be fixedly locked by the locking unit 66.

Figure 14:
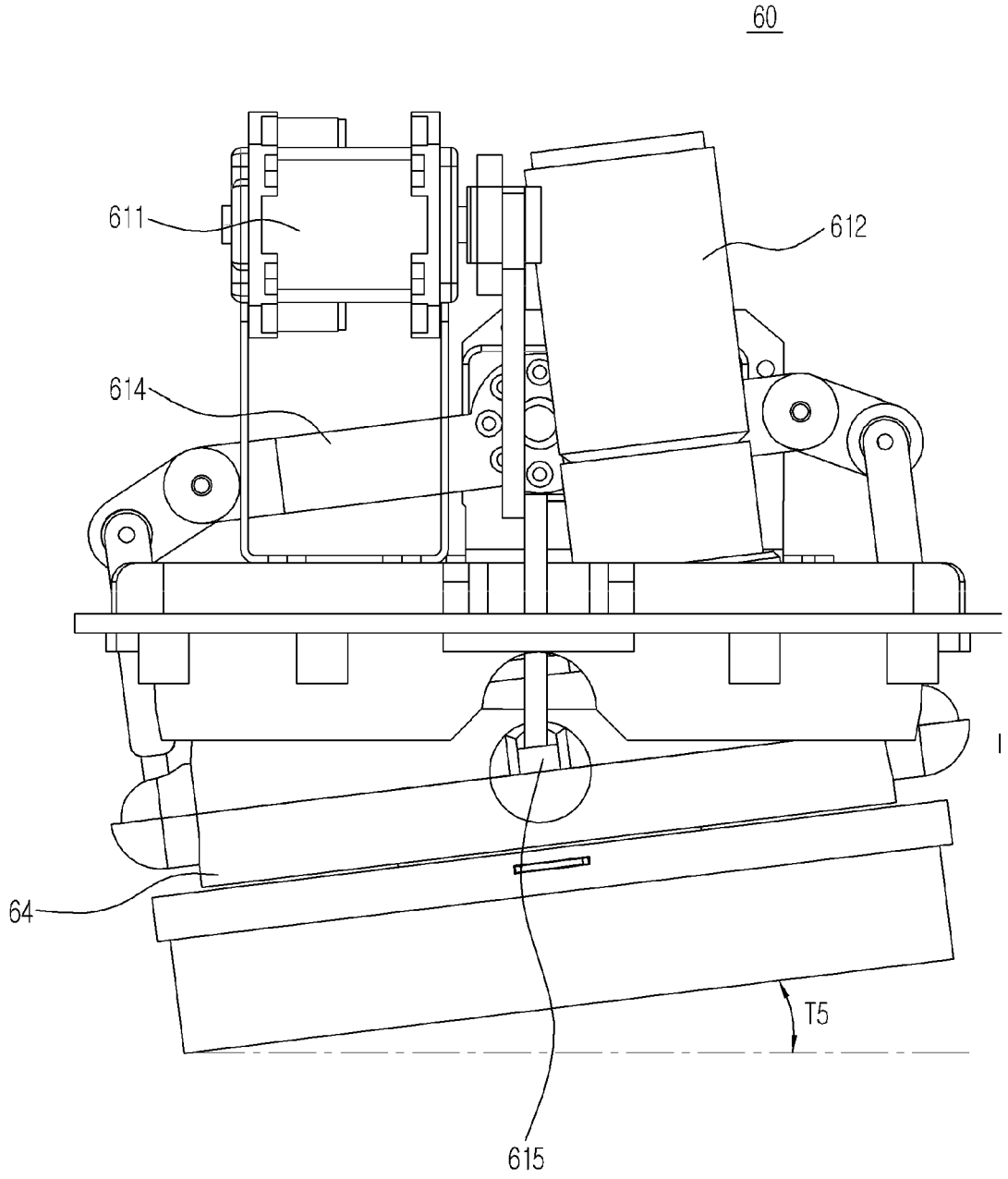
FIG. 14 is a view illustrating a rotating state of a rotating plate of the first driving unit about the X-axis in the robot cleaner according to one or more embodiments.
Figure 15:
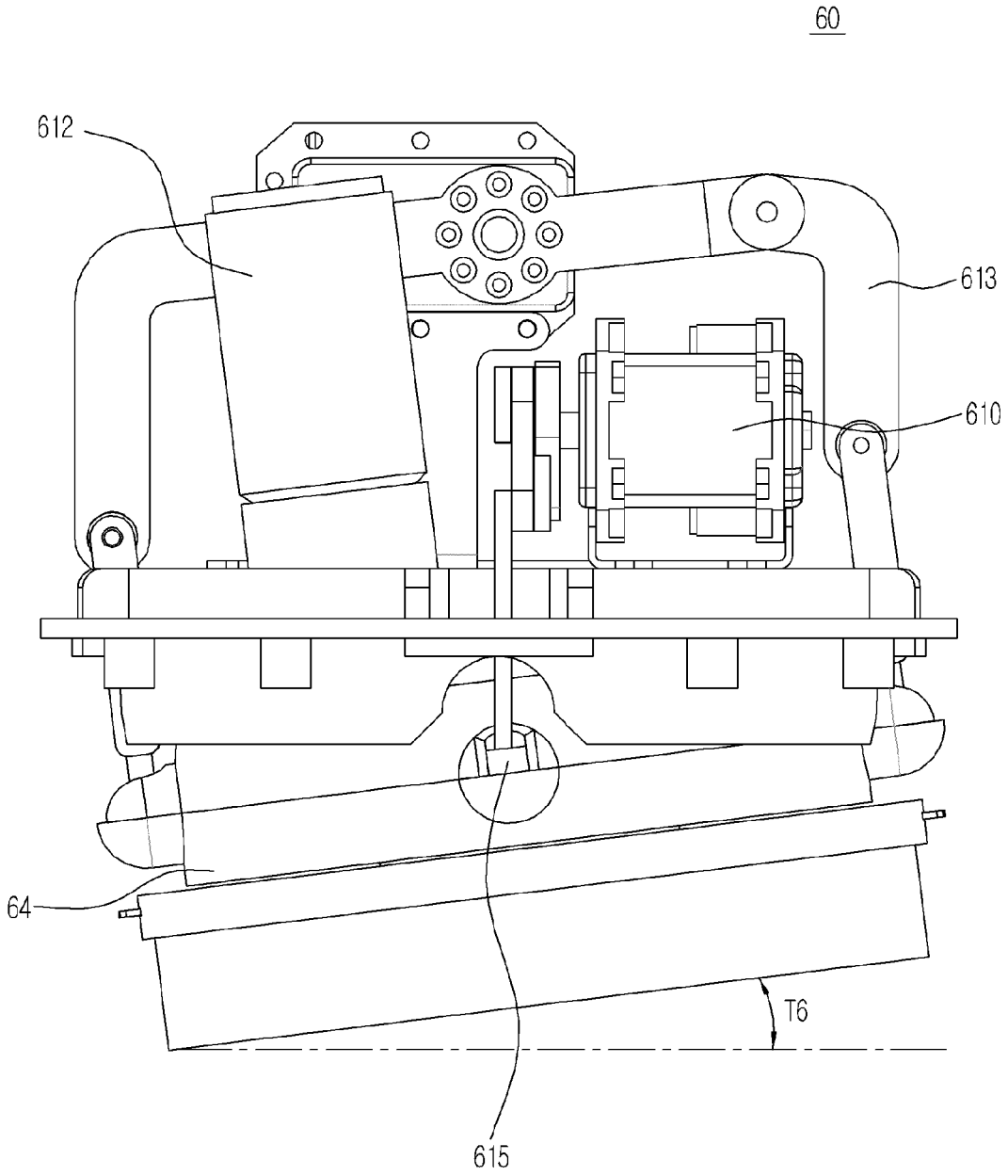
FIG. 15 is a view illustrating a rotating state of the rotating plate of the first driving unit about the Y-axis in the robot cleaner according to one or more embodiments.

FIG. 14 is a view illustrating a rotating state of the rotating plate of the first driving unit about the X-axis in the robot cleaner according to one or more embodiments, and FIG. 15 is a view illustrating a rotating state of the rotating plate of the first driving unit about the Y-axis in the robot cleaner according to one or more embodiments.

Referring to FIGS. 14 and 15, the rotating plate 640 of the first driving unit 60 may pivot about the X-axis or Y-axis in order to be slanted with respect to the floor by the first control motor 610 and the second control motor 611. For instance, if the first link 614 rotates clockwise or counterclockwise by rotation of the first control motor 610, the rotating plate 640 may pivot about the Y-axis according to the rotating direction of the first link 614 and may be slanted with respect to the floor. As the first link 614 rotates, the first subframe 62 and the second subframe 63 may pivot by the balls 615 provided at both end portions of the first link 614 and received in the ball receiving parts, and the rotating plate assembly 64 coupled to the first and second subframes 62 and 63 may also be pivoted thereby. Accordingly, the rotating plate 640 may pivot about the Y-axis to be slanted with respect to the floor.

If the second link 613 rotates clockwise or counterclockwise by rotation of the second control motor 611, the rotating plate 640 may pivot about the X-axis according to the rotating direction of the second link 613 and may be slanted with respect to the floor. As the second link 613 rotates, the first subframe 62 and the second subframe 63 may pivot by the balls 615 provided at both end portions of the second link 613 and received in the ball receiving parts, and the rotating plate assembly 64 coupled to the first and second subframes 62 and 63 may also be pivoted thereby. Accordingly, the rotating plate 640 may pivot about the X-axis to be slanted with respect to the floor.

As described above, if the rotating plate 640 may pivot about the X-axis or Y-axis and may be slanted with respect to the floor, even when the whole bottom surface of the pad 65 provided at the bottom surface of the rotating plate 640 comes into contact with the floor, frictional force between a specific portion of the bottom surface of the pad 65 and the floor may exceed frictional force between any other portion of the bottom surface of the pad 65 and the floor.

A control unit (not shown) may adjust the slanted angle and the slanted direction of the rotating plate 640 by controlling the first control motor 610 and the second control motor 611. The control method of the rotating plate 640 of the first driving unit 60 may be similarly applied to control of the rotating plate of the second driving unit 70. Further, the main body 4 may move in a specific direction according to the slanted angles and the slanted directions of the first and second driving units 60 and 70 and the rotating directions of the rotating plates 640 of the first and second driving units 60 and 70. The control method of movement of the main body in the previous embodiment may be similarly applied to control of movement of the main body 4 in this embodiment.

In addition to the first driving unit 60 and the second driving unit 70, the main body 4 may further include the third driving unit 80 and the fourth driving unit 90. If the second driving unit 70 is positioned next to the first driving unit 60, the third driving unit 80 is positioned to the rear of the first driving unit 60 and the fourth driving unit 90 is positioned to the rear of the second driving unit 70, the rotating plate 640 of the third driving unit 80 may move in the same rotating direction and slanted direction as the rotating plate 640 of the first driving unit 60, and the rotating plate 640 of the fourth driving unit 90 may move in the same rotating direction and slanted direction as the rotating plate 640 of the second driving unit 70. The number of driving units provided at the main body 4 is not limited to four. The first control motor, the second control motor, and the driving motor may be named the first motor, the second motor, and the third motor, respectively.

As is apparent from the above description, the robot cleaner according to the embodiments of the present invention may travel in all directions possibly without interference with obstacles. Further, since frictional force may be sufficiently generated between the pad and the floor, cleaning efficiency may be enhanced.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A robot cleaner comprising:

a main body including two or more driving units and a main frame; and a case disposed outside the main body to define an external appearance thereof, wherein each of the driving units includes:

a plurality of motors to generate rotational force, a first subframe disposed below the main frame and connected to a first motor among the plurality motors and configured to rotate by receiving the rotational force from the first motor;

a rotating plate assembly mounted to the first subframe and configured to be slanted with respect to a floor by rotation of the first subframe and to rotate clockwise or counterclockwise by receiving the rotational force from a second motor among the plurality of motors, and a pad provided at a bottom surface of the rotating plate assembly and configured to contact the floor, and wherein when the bottom surface of the rotating plate assembly is slanted with respect to the floor, a nonuniform frictional force is generated between a bottom surface of the pad and the floor, and the robot cleaner travels in a specific direction through the nonuniform frictional force.

2. The robot cleaner according to claim 1, wherein the first subframe rotates about an X-axis by the first motor and rotates about a Y-axis by the second motor, and the bottom surface of the rotating plate assembly is slanted with respect to the floor by rotation of the first subframe.

3. The robot cleaner according to claim 2, wherein a slanted direction and a slanted angle of the bottom surface of the rotating plate assembly with respect to the floor are changed according to a degree of rotation of the first subframe about the X-axis or the Y-axis, and wherein if the slanted direction of the bottom surface of the rotating plate assembly is changed, a traveling direction of the robot cleaner is changed, and when the slanted angle of the bottom surface of the rotating plate assembly is changed, the frictional force between the pad and floor is changed.

4. The robot cleaner according to claim 3, wherein the pad is made of a compressible material so that when the bottom surface of the rotating plate assembly is slanted with respect to the floor, a majority of the bottom surface of the pad comes into contact with the floor.

5. The robot cleaner according to claim 2, wherein the first motor is positioned above the first subframe and the first subframe is configured to rotate through a rotating shaft connecting the first motor to the first subframe.

6. The robot cleaner according to claim 2, wherein the second motor is positioned next to the first subframe and the first subframe is configured to rotate through a link connecting the second motor to the first subframe.

7. The robot cleaner according to claim 2, wherein the rotating plate assembly includes a rotating shaft mounted to the first subframe and a rotating plate mounted to the rotating shaft.

8. The robot cleaner according to claim 7, wherein the plural motors further include a third motor and the rotating plate is configured to rotate about the rotating shaft by the third motor.

9. The robot cleaner according to claim 8, wherein the robot cleaner travels by reaction to the frictional force between the pad and the floor, and a traveling direction of the robot cleaner is determined by a slanted direction with respect to the floor and a rotating direction of the rotating plate provided at each of the two or more driving units.

10. The robot cleaner according to claim 9, wherein the two or more driving units include a first driving unit and a second driving unit, and the first driving unit and the second driving unit are mounted to the main frame.

11. The robot cleaner according to claim 10, wherein if a right portion of the bottom surface of the rotating plate provided at the first driving unit and a right portion of the bottom surface of the rotating plate provided at the second driving unit contact the floor and if the rotating plate provided at the first driving unit rotates counterclockwise and the rotating plate provided at the second driving unit rotates clockwise, the robot cleaner performs cleaning of the floor at a stationary location.

12. The robot cleaner according to claim 1, wherein the main body includes a support frame extended from a bottom surface of the main frame and configured to contact the floor.

13. A robot cleaner comprising:

a main frame; and two or more driving units mounted to the main frame, each of the two or more driving units including:

a rotating plate assembly provided with a pad at a bottom surface thereof, a subframe disposed below the main frame to which the rotating plate assembly is mounted, a first motor connected with the subframe through a first link and configured to enable the subframe to be slanted with respect to a floor, a second motor connected with the subframe through a second link arranged to cross the first link and configured to enable the subframe to be slanted with respect to the floor, and a third motor mounted to the subframe and configured to rotate the rotating plate assembly, wherein when the subframe is slanted with respect to the floor, a nonuniform frictional force is generated between the pad and the floor, and the robot cleaner travels through the nonuniform frictional force and rotation of the rotating plate assembly.

14. The robot cleaner according to claim 13, wherein the first link and the second link are arranged perpendicular to each other.

15. The robot cleaner according to claim 13, wherein the rotating plate assembly includes a rotating shaft provided with a gear at an outer circumferential surface thereof and a rotating plate connected with the rotating shaft.

16. The robot cleaner according to claim 15, wherein the third motor is mounted with a gear unit, which is tooth-engaged with the gear of the rotating shaft.

17. The robot cleaner according to claim 16, wherein the first link or the second link is provided with balls, the subframe is provided with ball receiving parts in which the balls are respectively received, and the rotating plate rotates by rotational force of the first motor and the second motor.

18. The robot cleaner according to claim 15, wherein the subframe and the rotating plate are fixed to each other through a locking unit inserted through the subframe and the rotating plate.

19. The robot cleaner according to claim 13, further comprising a support frame extended from a bottom surface of the main frame and configured to contact the floor.

20. A robot cleaner comprising:

a main frame; and two or more driving units mounted to a subframe disposed below the main frame, each of the two or more driving units including:

a rotating plate assembly provided with a pad at a bottom surface thereof, a first motor configured to enable the rotating plate assembly to be slanted in a first direction with respect to a floor, a second motor configured to enable the rotating plate assembly to be slanted in a second direction with respect to the floor, and a third motor configured to rotate the rotating plate assembly, wherein when the rotating plate assembly is slanted with respect to the floor, a nonuniform frictional force is generated between the pad and the floor, and the robot cleaner travels through the nonuniform frictional force and rotation of the rotating plate assembly.

21. The robot cleaner according to claim 20, wherein the rotating plate assembly is mounted to the subframe, and wherein the first motor is connected with the subframe through a first link and the second motor is connected with the subframe through a second link arranged to cross the first link.

22. The robot cleaner according to claim 21, wherein the first link or the second link is provided with balls, the subframe is provided with ball receiving parts in which the balls are respectively received, and the rotating plate rotates by rotational force of the first motor and the second motor.

23. The robot cleaner according to claim 20, further comprising a support frame extended from a bottom surface of the main frame and configured to contact the floor.

* * * * *